US007081032B1

(12) United States Patent
Holgate

(10) Patent No.: US 7,081,032 B1
(45) Date of Patent: Jul. 25, 2006

(54) FLYING DISC HAVING CONTOURED FEATURES

(75) Inventor: Michael S. Holgate, Charlotte, NC (US)

(73) Assignee: Holgate Inc., Charlotte, NC (US)

( * ) Notice: Subject to any disclaimer, the term of this patent is extended or adjusted under 35 U.S.C. 154(b) by 158 days.

(21) Appl. No.: 10/757,852

(22) Filed: Jan. 14, 2004

Related U.S. Application Data

(63) Continuation-in-part of application No. 29/197,223, filed on Jan. 12, 2004.

(60) Provisional application No. 60/439,562, filed on Jan. 14, 2003.

(51) Int. Cl.
*A63H 27/00* (2006.01)

(52) U.S. Cl. ..... 446/46

(58) Field of Classification Search ..... 446/46–48; D21/443–444; 473/588–590
See application file for complete search history.

(56) References Cited

U.S. PATENT DOCUMENTS

| | | | | |
|---|---|---|---|---|
| 3,110,494 | A * | 11/1963 | Morgan | 473/458 |
| 3,359,678 | A | 12/1967 | Headrick | |
| 3,594,945 | A | 7/1971 | Turney | |
| D225,250 | S * | 11/1972 | Sun | D21/444 |
| 4,075,781 | A * | 2/1978 | Hill et al. | 446/48 |
| 4,132,030 | A * | 1/1979 | Lehman | 446/46 |
| 4,568,297 | A | 2/1986 | Dunipace | |
| D291,901 | S * | 9/1987 | Chapman | D21/444 |
| 4,737,128 | A * | 4/1988 | Moormann et al. | 446/46 |
| 4,979,922 | A * | 12/1990 | Clark | 446/46 |
| D337,623 | S | 7/1993 | Franker | |
| D362,470 | S * | 9/1995 | Smith | D21/443 |
| 5,531,624 | A | 7/1996 | Dunipace | |
| 5,676,581 | A * | 10/1997 | Ziegler | 446/46 |
| 2003/0171170 | A1* | 9/2003 | Tarng et al. | 473/588 |

FOREIGN PATENT DOCUMENTS

| | | | |
|---|---|---|---|
| CA | 1153033 | A * | 8/1983 |
| WO | WO 9803239 | A1 * | 1/1998 |
| WO | WO 9809698 | A1 * | 3/1998 |

* cited by examiner

*Primary Examiner*—John A. Ricci
(74) *Attorney, Agent, or Firm*—Everman Law Firm, PA; Gregory R. Everman

(57) ABSTRACT

A flying disc for use in recreational activities and sports, such as for catch and throw, Ultimate, disc golf, and the like. The flying disc is configured for enhanced flight characteristics, throwability, trick shot capability and durability. The flying disc includes a circular flight deck section and an outer rim connected thereto. Contoured features are provided in a pattern in the flight deck section. The contoured features define cavities in the flight deck section and protrude beneath the flight deck section. The contoured features provide a variety of gripping positions on the top and bottom of the disc for generating greater snapping force when releasing the disc. The contoured features also create a Coanda effect that stabilizes the disc during flight. And, since the contoured features are recessed from the top of the flight deck section, the advantages of flight stability are achieved without a loss of flight distance.

17 Claims, 11 Drawing Sheets

FLYING DISC HAVING CONTOURED FEATURES

CROSS REFERENCE TO RELATED APPLICATION

This application claims the benefit of U.S. Provisional application Ser. No. 60/439,562, filed Jan. 14, 2003, and is a continuation-in-part of U.S. Design Pat. Application No. 29/197,223, filed Jan. 12, 2004, both of which are hereby incorporated by reference.

BACKGROUND OF THE INVENTION

1. Field of the Invention

The present invention relates generally to the art of flying discs and, more particularly, to flying discs having features for gripping and for controlling disc flight.

2. Description of the Related Art

Flying discs are used in many recreational activities, the most common being the game of throw and catch. Another disc sport is Ultimate, which is similar to soccer or football in which a team advances the disc by throwing only.

In recent years, the disc sport of disc golf has grown in popularity. Disc golf is similar to golf, but instead of striking a golf ball a player throws a flying disc towards a basket shaped target that serves as the "hole".

Most holes in disc golf are about 100 yards (60 meters) long and a player gets three "shots" or throws in order to make "par" for the hole. Effective scoring in disc golf requires not only the ability to "drive" a flying disc a long distance, but also to accurately control the flight of the disc in order to position shots and "putt" i.e. engage the target. In disc golf, it is common to use different discs, which exhibit the desired performance characteristics, for driving and putting.

For each of the sports, and particularly disc golf, other desired flying disc characteristics include (1) throwability—how easily the disc is gripped and released, feel, and the ability to transmit throwing power to the disc, (2) flight characteristics—including flight stability, flight path, flight path precision, drag, lift, ballistics, and the susceptibility to flight path deflection by wind, (3) trick shot capability—such as curving the disc around a tree and rolling the disc along the ground, and (4) durability—how a disc resists wear and tear including scuffing and collisions (such as trees and disc golf targets) and what affect impact has on throwability and flight characteristics.

Regarding flight stability in greater detail, stability is how well a flying disc holds its intended line of flight. A thrower desires a disc to fly in a predictable pattern despite varying or high wind conditions, or when the disc is thrown at high speed (such as for longer distance throws or throws into the wind), medium speed (such as for medium distance throws or when playing catch), or low speed (such as for short throws or when putting in disc golf).

Notwithstanding, a disc's flight path is typically not a perfectly straight line but actually an "S" curve. If the degree of the "S" curve is too extreme, the disc is not readily controllable and is considered "unstable". A disc that is "unstable" will undesirably turn over and fall i.e "crash" when thrown at a given speed. A disc may still be considered "stable" despite a tendency of the disc to bank slightly to the side (right or left). In the sport of disc golf, some discs are used for that very purpose. In disc golf parlance, a disc is "overstable" if it has a tendency to bank slightly opposite to the direction of spin (i.e. slightly to the left for a right handed backhand throw) at a given speed. Similarly, a disc is "understable" if it banks slightly in the direction of spin (i.e. to the right for a right handed backhand throw).

A conventional flying disc is made by Frisbee®, such as the Pro™ model. This disc has a flat central section and an arcuate section transitioning from the central region to a downwardly extending rim having a blunt edge. Although the Frisbee® Pro™ flying disc has acceptable performance, disc enthusiasts continue to seek improvements in throwability, flight characteristics, trick shot capability and durability.

Another conventional flying disc is described in U.S. Pat. No. 4,568,297 to David B. Dunipace, which is manufactured and sold by Innova Champion Discs, Inc. of Ontario, Calif. This disc has a low profile, a triangular rim providing increased mass at the rim, and a flexible central section, in order to increase throwing distance.

A later patent to David B. Dunipace, U.S. Pat. No. 5,531,624, discloses a flying disc comprising an outer rim having a raised ridge that provides a gripping surface and may also act as a rear spoiler in order to provided increased control. However, the Dunipace disc provides the gripping surface only at a specific distance from the rim, limiting feel, trick shot capability and throwability that otherwise may have been obtained by gripping the disc at alternative locations. Moreover, the raised ridge may cause increased drag thereby reducing travel of the disc.

Accordingly, there is a need in the art of flying disc to continue to improve disc characteristics. In particular, there is a need to continue to improve throwability, flight characteristics, trick shot capability and durability of flying discs.

BRIEF SUMMARY OF THE INVENTION

To achieve the foregoing and other objects, and in accordance with the purposes of the invention as embodied and broadly described herein, the present invention provides various embodiments of a flying disc for use in recreational activities and sport, such as for catch and throw, Ultimate, disc golf, and the like. The flying disc is configured for enhanced flight characteristics, throwability, trick shot capability and durability.

In one embodiment, the flying disc includes a central deck section and a rim connected to the central deck section. At least one contoured feature is provided in the central deck section. Optionally, the contoured features are recessed within the central deck section and protrude beneath a plane defined by the central deck section. Also optionally, the contoured features define cavities having a maximum depth in the range from 0.25 cm to 0.55 cm and a span across their major axis in the range of 1.5 cm to 3.5 cm. The contoured features provide a variety of gripping positions on the top and bottom of the disc for assisting a thrower in generating a greater snapping force when releasing the disc. The contoured features also create a Coanda effect that stabilizes the disc during flight.

In another embodiment, the flying disc includes a central deck section having a plurality of contoured features and a rim that is integral with the central deck section. The contoured features define cavities within the central deck section. Optionally, at least two of the contoured features are equal-distantly spaced from the central axis of the disc as measure in the radial direction from the central axis. As another option, the contoured features are positioned at two or more distances, as measure radially from the central axis of the disc. As a further option, each of the contoured features are positioned at a different distance from the central axis of the disc, as measured in the radial direction from the central axis.

In still another embodiment, the flying disc includes a central deck section and a rim connected thereto. Means are provided in the central deck section for creating a Coanda effect.

BRIEF DESCRIPTION OF THE DRAWINGS

These and other features, aspects and advantages of the present invention are better understood when the following detailed description of the invention is read with reference to the accompanying drawings, in which.

DETAILED DESCRIPTION OF THE INVENTION

Figure 1:
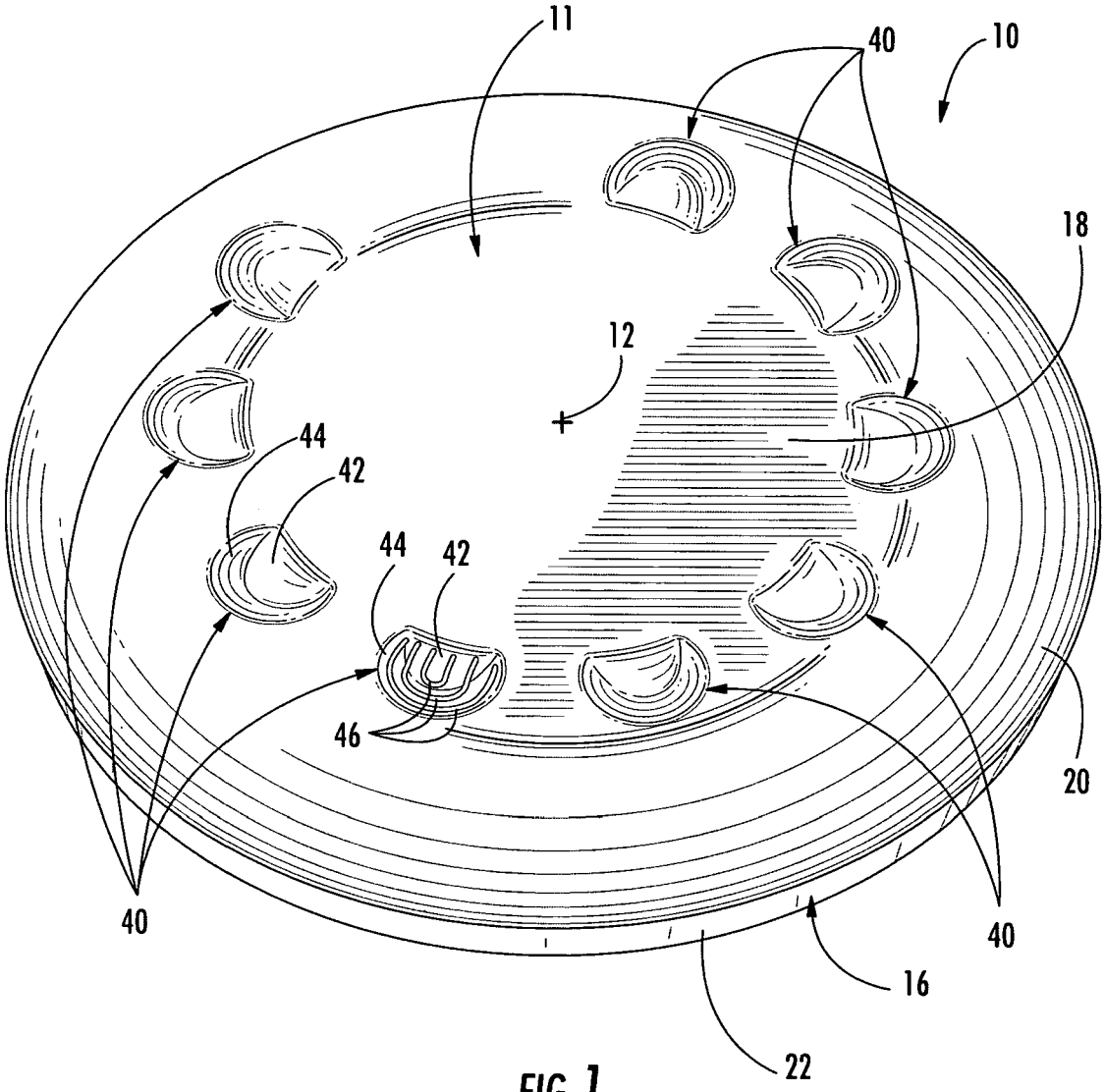
FIG. 1 is a perspective view of a flying disc having contoured features arranged in a semi-circular pattern that is eccentrically positioned from the central axis of the disc, wherein each contoured features is recessed from the top surface of the flight deck section and protrudes from the bottom surface of the flight deck section, in accordance with an exemplary embodiment of the present invention.

The present invention will now be described more fully hereinafter with reference to the accompanying drawings in which exemplary embodiments of the invention are shown. However, this invention may be embodied in many different forms and should not be construed as limited to the embodiments set forth herein. These exemplary embodiments are provided so that this disclosure will be both thorough and complete, and will fully convey the scope of the invention to those skilled in the art. Like reference numbers refer to like elements throughout the various drawings.

It may be noted that in the description herein, a disc may be described and/or claimed by terms such as "top", "bottom", "beneath", "downward", "upward", "inner", "outer", "central", or the like, for the purpose of facilitating description of the disc structure. These terms are intended as relative terms to describe relative directions about the disc structure as though the disc being described were observed in a horizontal, upright orientation as illustrated in the front, rear and side views herein. In other words, the disc may be described relative to a conventional coordinate system (polar or ordinate) which is centered on the disc. As a further clarification, the term "inner" means radially toward the center of the disc and "outer" means radially away from the center of the disc.

The present invention is a flying disc having enhanced throwability, flight characteristics, trick shot capability and durability. In particular, the flying disc embodiments have contoured features for ergonomic gripping by the thrower. The features are formed at a plurality of locations in the flying disc in order to facilitate gripping the disc in a variety of fashions, including grips for trick shots.

The contoured features also allow for the thrower to transfer greater force into the disc during the launch release by providing surfaces against which the thumb and/or finger press during the snapping motion that is associated with throwing a disc.

Further, the contoured features create a Coanda effect during flights with high speed (velocity and revolutions), thereby stabilizing disc flight. The features may be formed in such a way that they cause only de minimis drag. As such, the benefits of the contoured features are provided without undesirably causing a reduction in flight distance. Also, the size, shape, mass and location of the contoured features may be varied in order to provide different effects and specific flight characteristics.

Referring to the drawings, and particularly FIGS. 1–7, an embodiment of the flying disc 10 is illustrated. The configuration illustrated is suitable for accurate, medium to low speed, throws, such as those used during "putting" in disc golf.

The flying disc 10 is preferably a unitary structure that is integrally molded from flexible plastic material. Not to be construed as limiting, the disc typically has a mass of about 120 gm–130 gm for recreational catch-style and a mass up to about 200 gm for a golf style disc, with about 60% of the mass contained in the rim. Nevertheless, weight and weight distribution for the disc may be modified by the disc designer. It should also be noted that the upper weight range is arbitrarily dictated by the Professional Disc Golf Association which limits the weight of approved discs to a maximum weight to diameter ratio.

Figure 2:
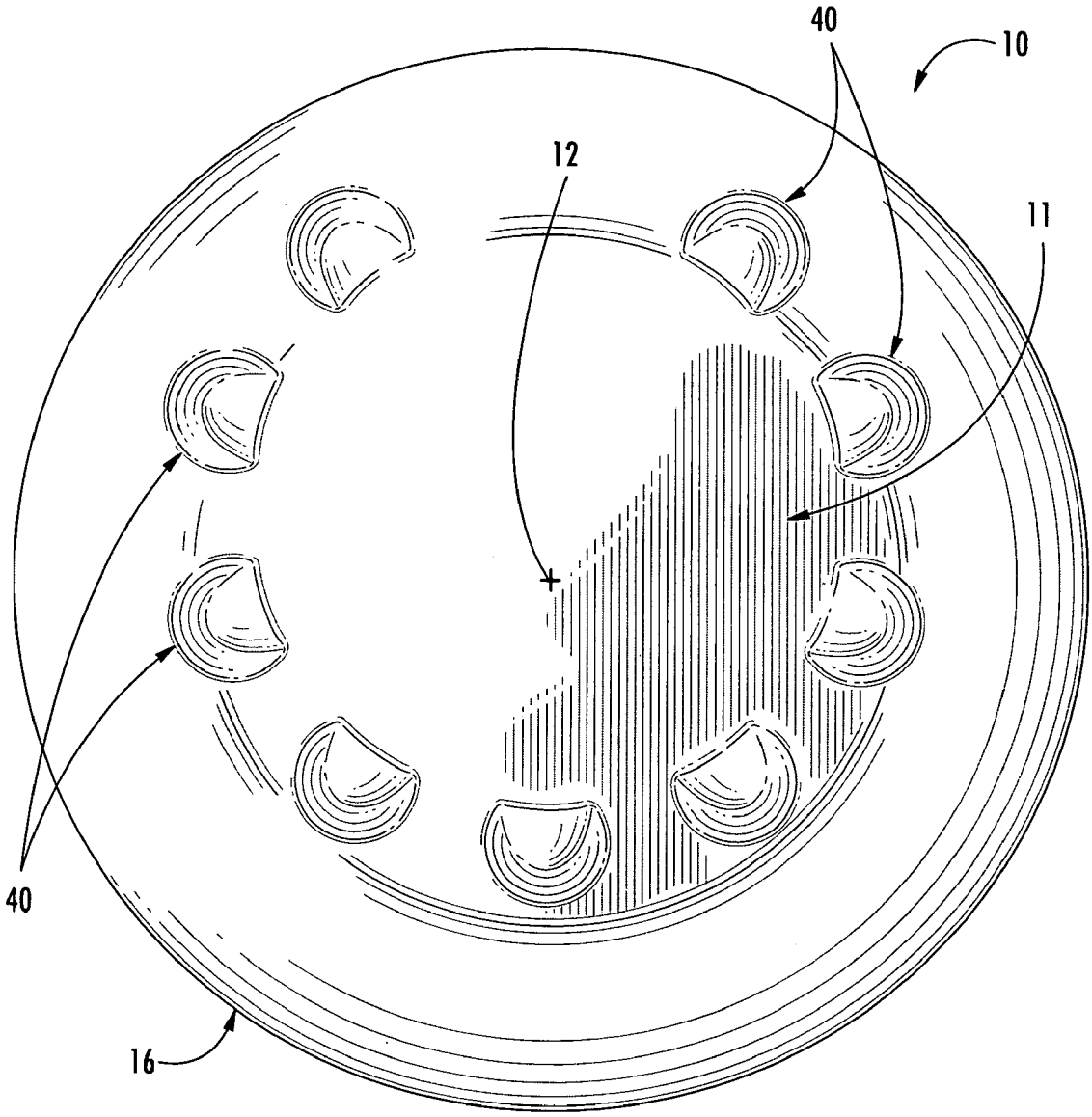
FIG. 2 is a top view of the flying disc of FIG. 1 in accordance with an exemplary embodiment of the present invention.
Figure 3:
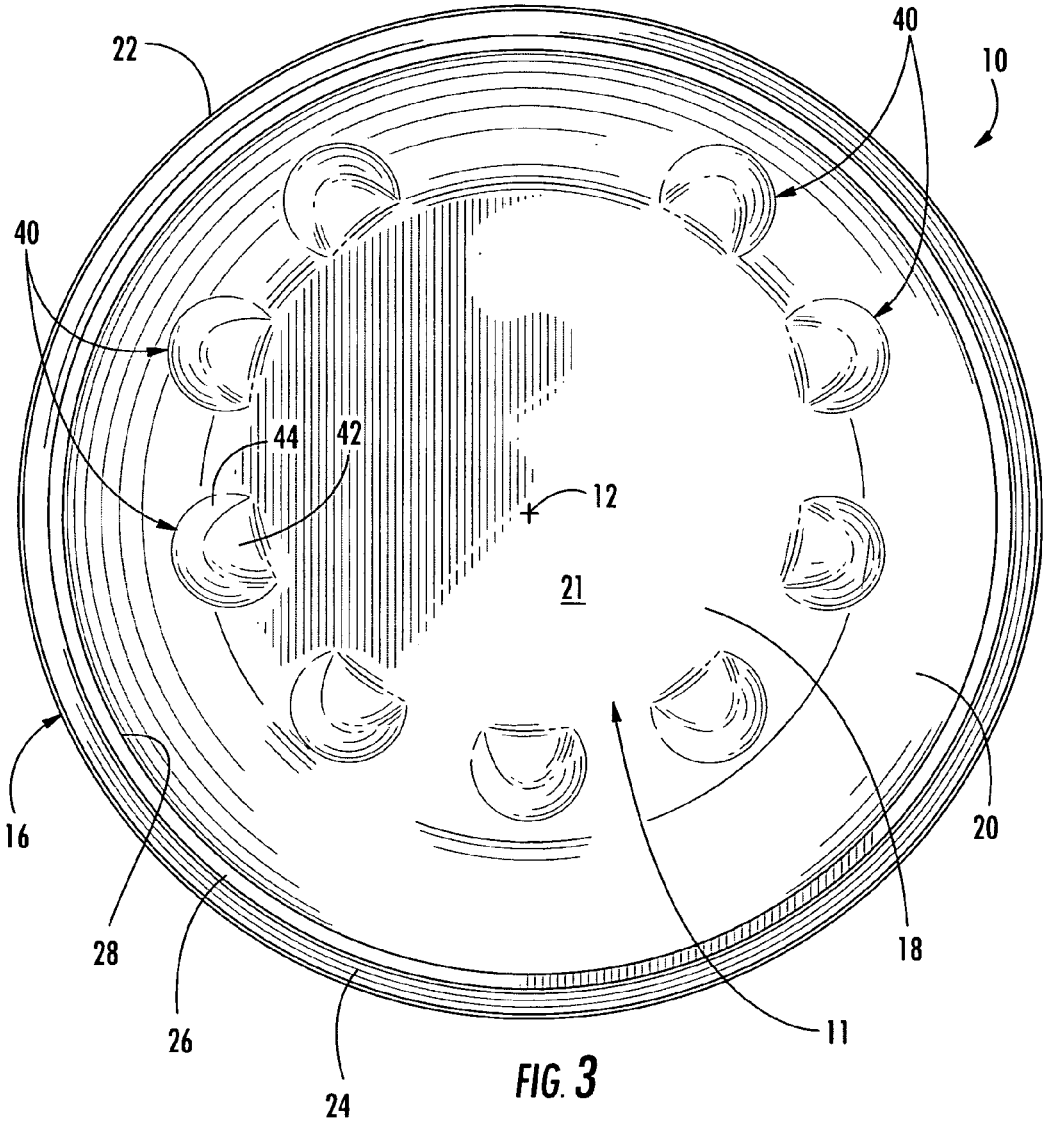
FIG. 3 is a bottom view of the flying disc of FIG. 1 in accordance with an exemplary embodiment of the present invention.
Figure 4:
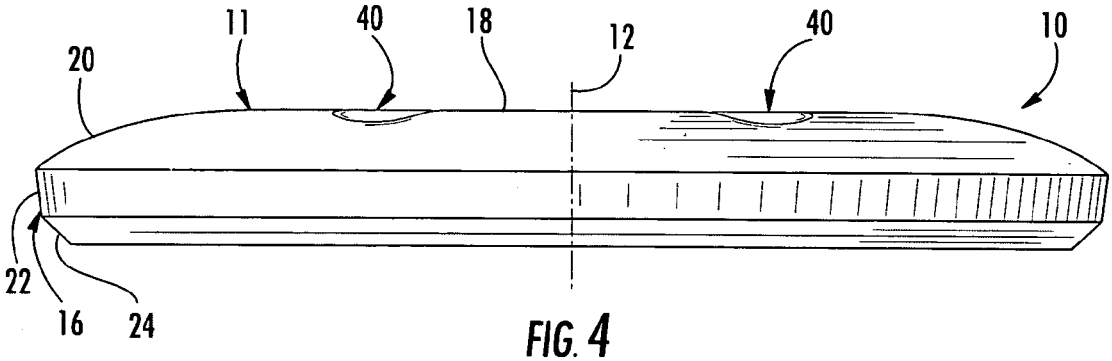
FIG. 4 is a rear view of the flying disc of FIG. 1 in accordance with an exemplary embodiment of the present invention.
Figure 5:
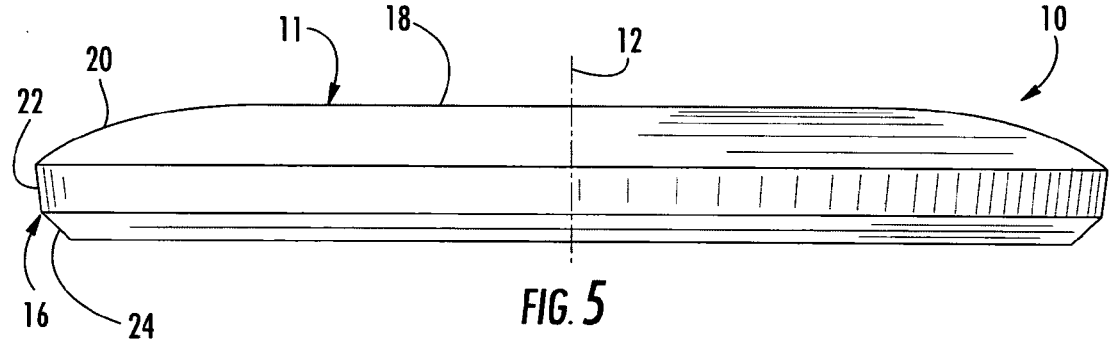
FIG. 5 is a front view of the flying disc of FIG. 1 in accordance with an exemplary embodiment of the present invention.
Figure 6:
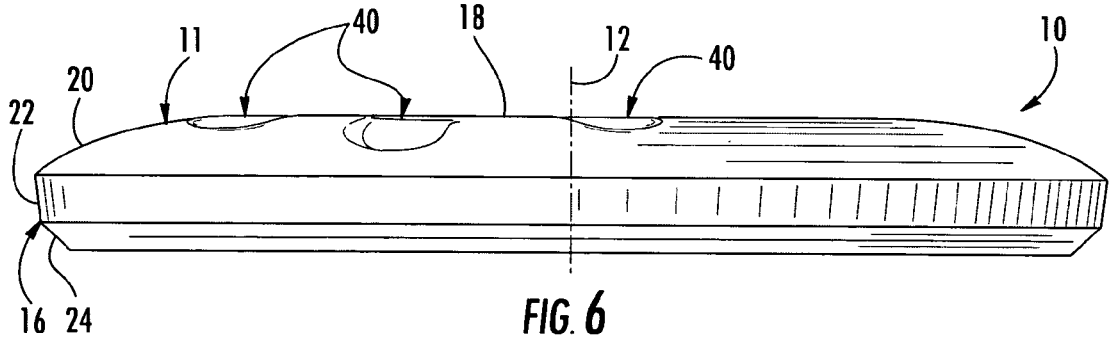
FIG. 6 is a left side view of the flying disc of FIG. 1 in accordance with an exemplary embodiment of the present invention.
Figure 7:
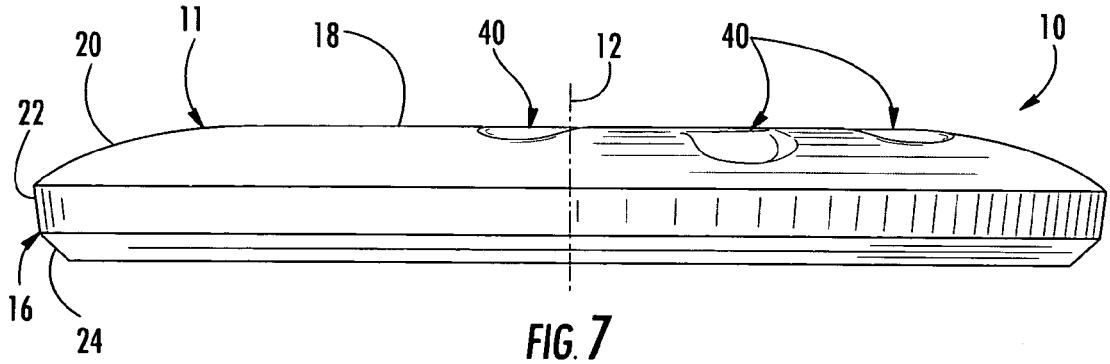
FIG. 7 is a right side view of the flying disc of FIG. 1 in accordance with an exemplary embodiment of the present invention.
Figure 8:
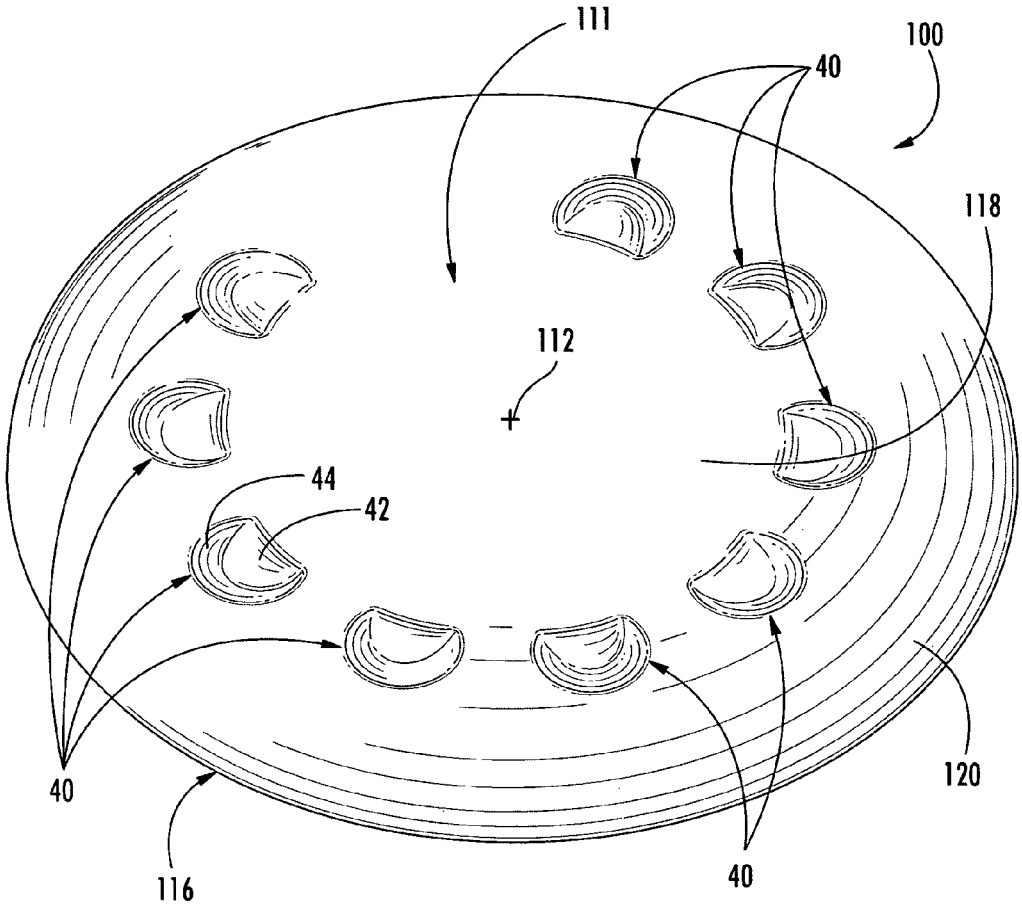
FIG. 8 is a perspective view of another flying disc having contoured features arranged in a semi-circular pattern that is eccentrically positioned from the central axis of the disc, wherein each contoured feature is recessed from the top surface of the flight deck section and protrudes from the bottom surface of the flight deck section, in accordance with an exemplary embodiment of the present invention.

The disc 10 has a circular flight deck section 11 (as shown in FIGS. 2 and 3) extending from a central axis 12 to an outer rim 16. The flight deck section 11 is comprised of a central section 18, and an arcuate transition section 20 connecting the deck section 11 to the outer rim 16.

The central section 18 typically is flat with uniform thickness, but in less preferred configurations it may be convex (i.e. domed) or concave and the thickness may vary such as, for example, by increasing in thickness from the central axis 12 to the transition section 20. It is preferred that the center section 18 be sufficiently thin and flexible so that the disc 10 will resiliently bend upon impact in order to absorb energy and minimize potential damage to the disc 10. It should also be noted that flexibility for golf disc are dictated by the Professional Disc Golf Association.

Referring to FIGS. 1–7, the rim 16 extends downwardly from the transition section 20, bounding a central hollow 21 (FIG. 3) beneath the flight deck section 11. The rim 16 has a slightly inwardly angled outer edge 22, an inwardly angled shoulder 24, a downward facing bottom surface 26 (FIG. 3), and an inner rim surface 28 (FIG. 3) that defines, in a radial sense, the outer boundary of the central hollow 21 (FIG. 3).

The illustrated rim 16, being somewhat blunt in configuration, is suitable for accurate, short to medium length, throws, such as those made during putting in disc golf. As it will be appreciated by those skilled in the art of flying disc engineering, other rim configurations may be used in order to provide desired aerodynamics and, hence, this application is not to be construed to being limited to any particular rim configuration. For example, and described below with respect to the embodiment illustrated in FIGS. 9–14, a rim may be sharply angled in order to cut through the air with less drag; a configuration more suitable for long throws, such as those desired during driving in disc golf.

Referring to FIGS. 1 and 2, contoured features 40 are formed in the flight deck section 11 of the flying disc 10 for providing desired flight performance characteristics. Each contoured feature 40 defines a cavity in the flight deck section 11. More preferably, each contoured feature 40 also defines a protrusion extending from the bottom surface of the deck section 11 (FIG. 3). That is, in the preferred embodiment, the contoured features 40 extend beneath the curvilinear plane defined by the flight deck section 11 and, more preferably, the cavities also extend beneath the flight deck plane. It is noted that the contoured features 40 may include a raised portion, or lip, that extends above the flight deck section 11, however, such a configuration is not preferred as additional drag would occur during disc flight.

The contoured features 40 improve flight stability by creating a Coanda effect. That is, as the disc revolves and travels, air passing over the disc is entrained by the surfaces of the disc, including the contoured features 40, causing an effect similar to having a rear spoiler at the trialing edge of the disc 10. In a sense, the contoured features 40 collectively act as virtual groove in the disc 10, wherein, in general, the greater the number of contoured features 40 the greater the effect. Whatever the aerodynamic effect, the present inventor has recognized that by changing the size, shape, amount, pattern and location of these contoured features 40, the spoiler effect may be controlled to result in specific preferred flight characteristics. Moreover, the contoured features 40 may have added mass, for example by making them thicker, in order to create various centrifugical effects that govern flight characteristics of the disc 10 for various preferred aerodynamic action.

By having the contoured features 40 recessed from the flight deck section 11, the benefits of flight control are provided without a loss of distance. That is, the cavity portion of the contoured features 40 causes insignificant additional drag during the course of disc flight. Likewise, the protrusion portion of the contoured features 40 have an insignificant effect on airflow as the projections are smooth in form and are disposed within the disc hollow 21.

Referring to FIG. 1, the contoured features 40 also enhance throwability by providing a gripping surfaces against which the thrower may apply pressure during the snapping release that is associated with throwing a flying disc. That is, by being able to press a thumb partially into a contoured feature 40, the thrower may apply greater pressure during disc release in order to create a greater snapping force.

Not only may the thrower grip within the cavity portion of the contoured features 40, but also the protrusion portion as well. As it will be appreciated by the disc golf player, the protrusion of the contoured features 40 beneath the flight deck section 11 may be gripped by the thrower in order to facilitate trick shots.

Preferably, the contoured features are sized and shaped for ergonomically accommodating the heel of an average adult thumb. Preferably, the contoured features 40 include a U-shaped downwardly angled first section 42 and a C-shaped upwardly angled second section 44. Not to be construed as limiting, the contoured features are preferably about 1.5 cm to 3.5 cm, and more preferably about 2 cm to 2.5 cm, across their major axis. As defined herein, the major axis is the maximum distance across a cavity. Also not to be construed as limiting, the cavities have a maximum depth preferably about 0.2 cm to 0.6 cm and, more preferably about 0.35 cm to 0.45 cm. By being able to press a thumb partially into a contoured feature 40, the thrower may apply greater pressure during disc release in order to create a greater snapping force. The contoured features 40 may also have ridges or indentations (see example of gripping rings 46 in FIG. 1), but generally the features 40 are smooth. The above size and shape of the contoured features 40 are preferred example values and may be modified by the disc designer. That is, the contoured features 40 may have any shape or size, as desired.

The contoured features 40 may be provided in any variety of flying disc. Accordingly, the teachings of this application are not to be construed as being limited to any particular flying disc.

For example, FIGS. 8–14 illustrate a disc 100 suitable for being used as a driver in disc golf. The configuration of the disc 100 is similar to that previously described with respect to the embodiment of FIGS. 1–7, except that the disc 100 is flatter, with a sharply angled rim 116, and having greater mass percentage in the rim 116, in order to travel through the air with less air resistance.

Figure 9:
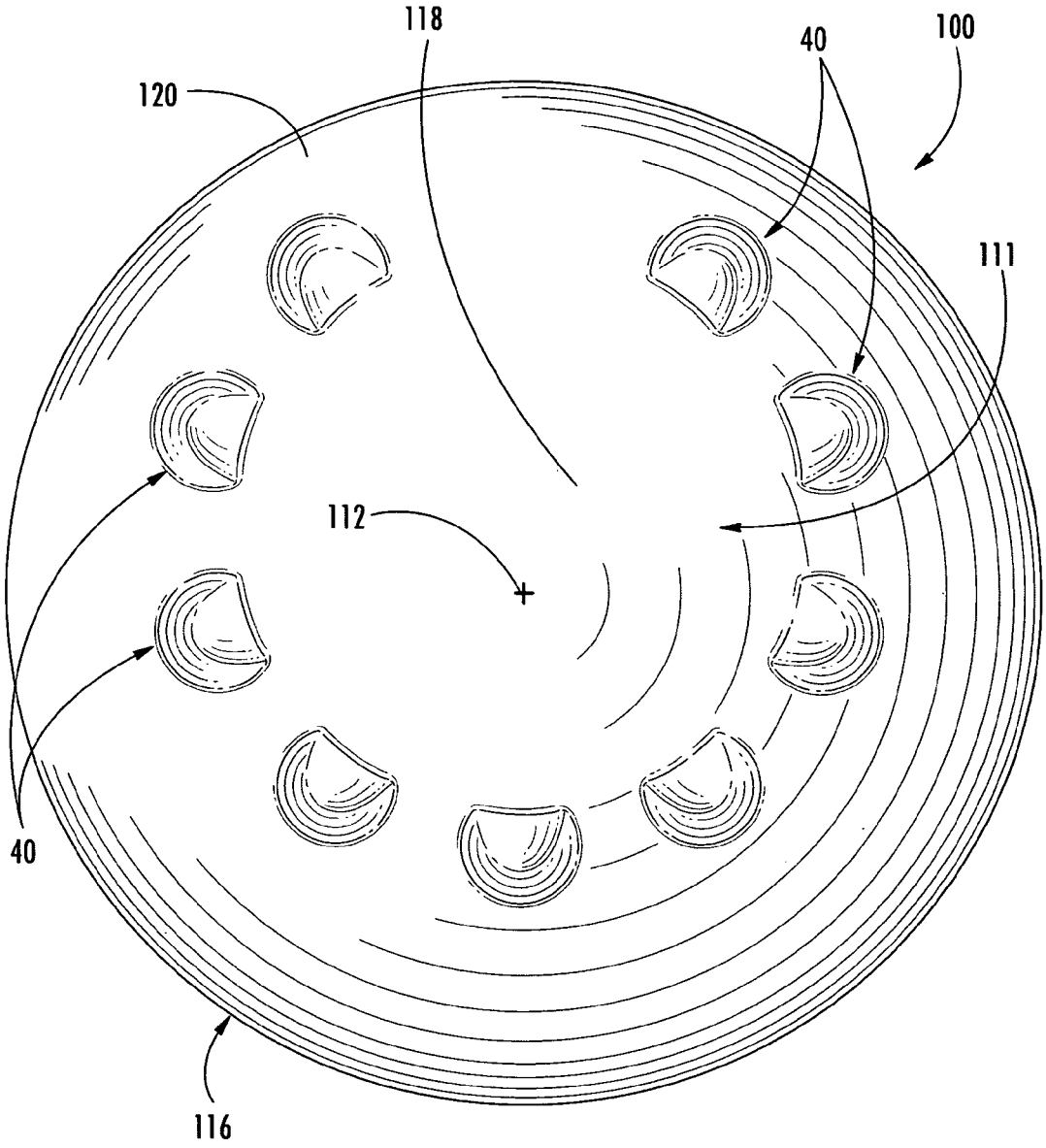
FIG. 9 is a top view of the flying disc of FIG. 8 in accordance with an exemplary embodiment of the present invention.
Figure 10:
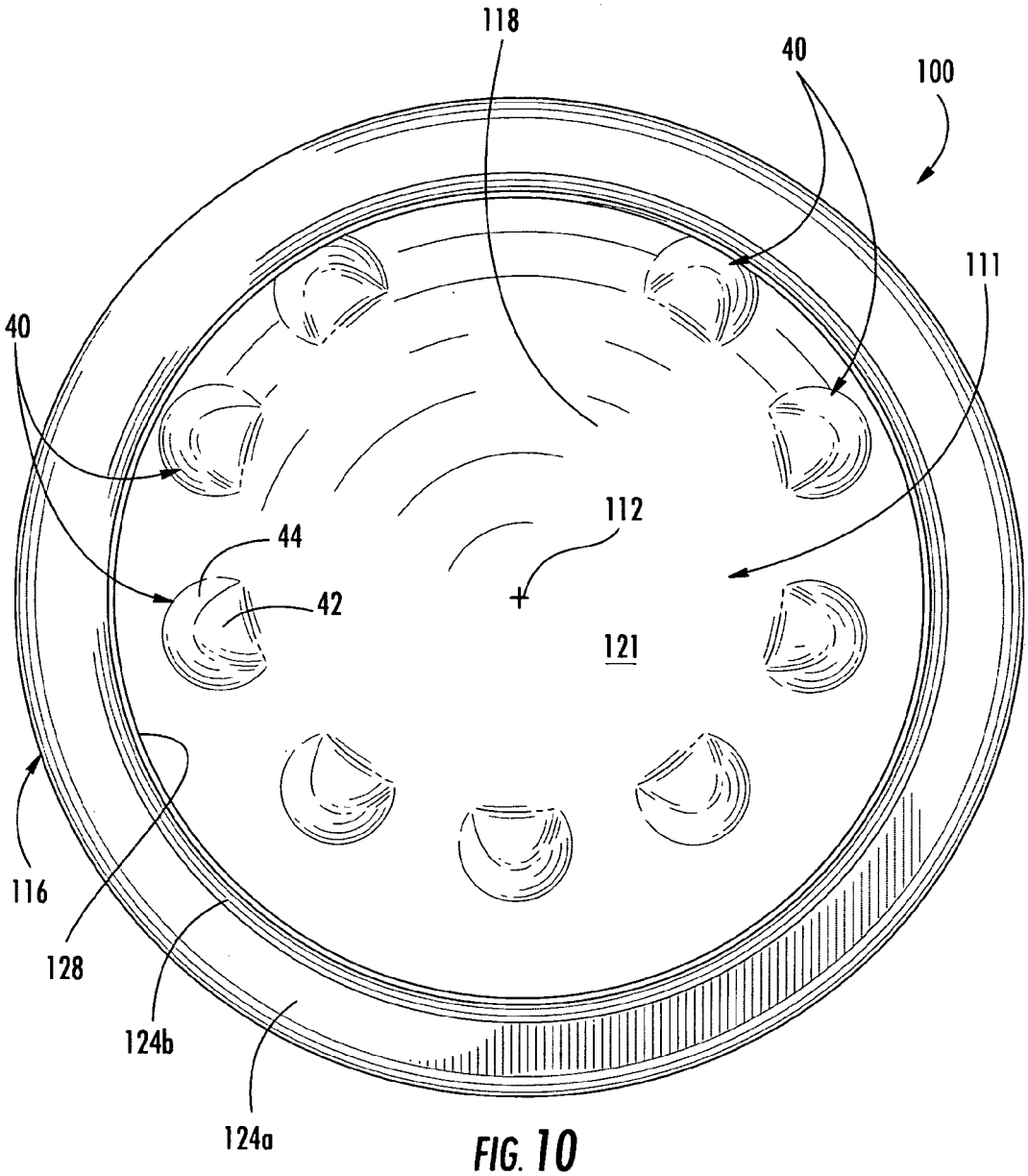
FIG. 10 is a bottom view of the flying disc of FIG. 8 in accordance with an exemplary embodiment of the present invention.
Figure 11:
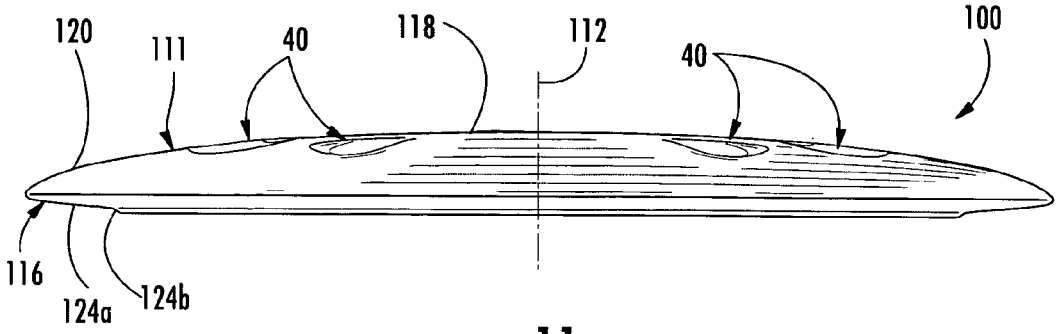
FIG. 11 is a rear view of the flying disc of FIG. 8 in accordance with an exemplary embodiment of the present invention.
Figure 12:
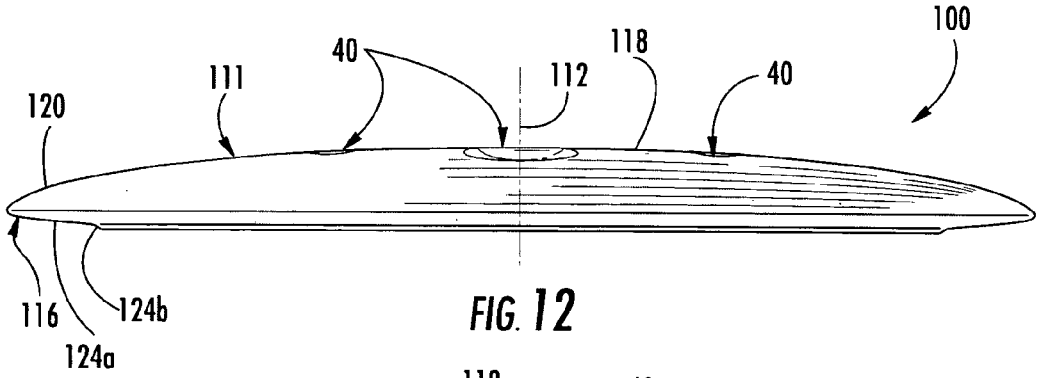
FIG. 12 is a front view of the flying disc of FIG. 8 in accordance with an exemplary embodiment of the present invention.
Figure 13:
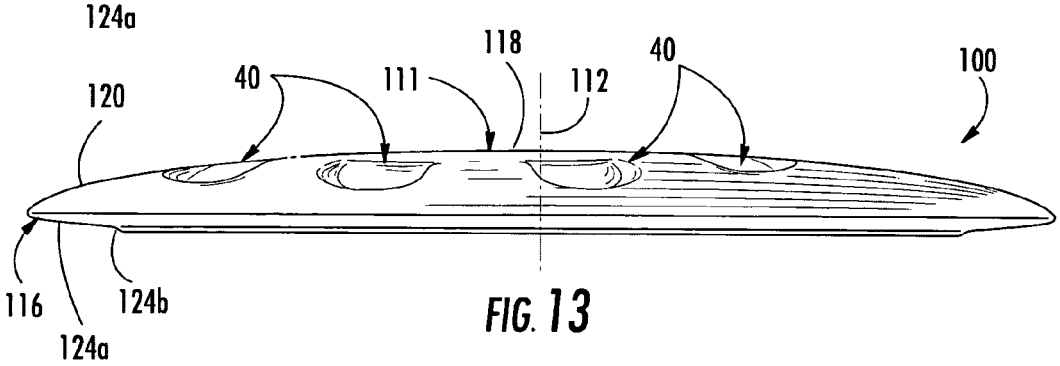
FIG. 13 is a left side view of the flying disc of FIG. 8 in accordance with an exemplary embodiment of the present invention.
Figure 14:
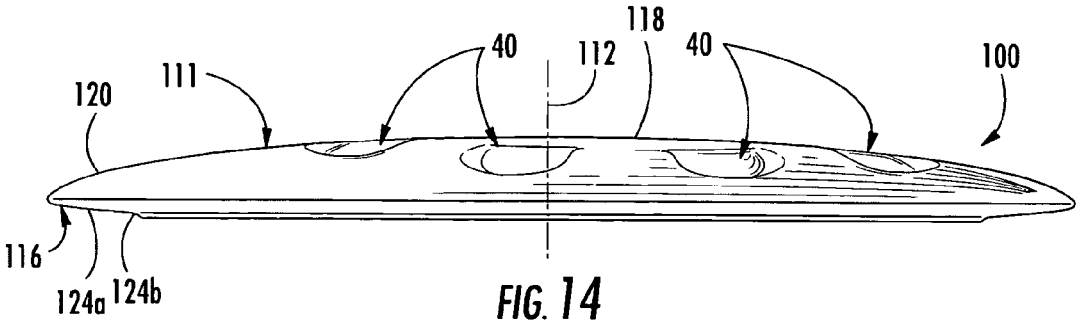
FIG. 14 is a right side view of the flying disc of FIG. 9 in accordance with an exemplary embodiment of the present invention.

Briefly stated, the disc 100 has a circular flight deck section 111 (as shown in FIGS. 9 and 10) extending from a central axis 112 to an outer rim 116. The flight deck section 111 is comprised of a central section 118, and an arcuate transition section 120 connecting the deck section 111 to the outer rim 116.

Referring to FIG. 10, the rim 116 extends downwardly from the transition section 120, bounding a central cavity 121 beneath the flight deck section 111. The rim 116 has stepped, sharply inwardly angled shoulder 124*a*, 124*b*, and an inner rim surface 128 that defines, in a radial sense, the outer boundary of the central cavity 121.

Contoured features 40 are provided in the flight deck section 111 for allowing different throwing grips and for creating a Coanda effect as the disc 100 is traveling through the air. The contoured features 40 are the same as described in accordance with the embodiment illustrated by FIGS. 1–7. In brief, the contoured features 40 define cavities in the flight deck section 111 and form protrusions extending beneath a curvilinear plane defined by the flight deck section 111.

The contoured features 40 may be provided in a variety of patterns in order to allow for different grips to be used. By having different gripping locations, the disc accommodates different types of throws, gripping preferences and different hand sizes.

For example, the embodiments illustrated by FIGS. 2 and 9 show the contoured features 40 eccentrically positioned from the central axis 12 in a semi-circular pattern. The contoured features 40 provide gripping surfaces at varying distances from the disc rim 16, as well as a blank location for an open ended grip.

FIGS. 15–20 illustrated examples of alternative contoured feature patterns. In each case, the contoured features 40 are configured as described in the previous embodiments. Additionally, for convenience, the patterns are illustrated as being formed in a disc 100*a*–*f* having a circular flight deck section 111 extending from a central axis 112 to an outer rim 116, as described in accordance with the embodiment illustrated by FIGS. 8–14. It is to be understood that the pattern of contoured features 40 may be presented in any variety of flying disc.

Figure 15:
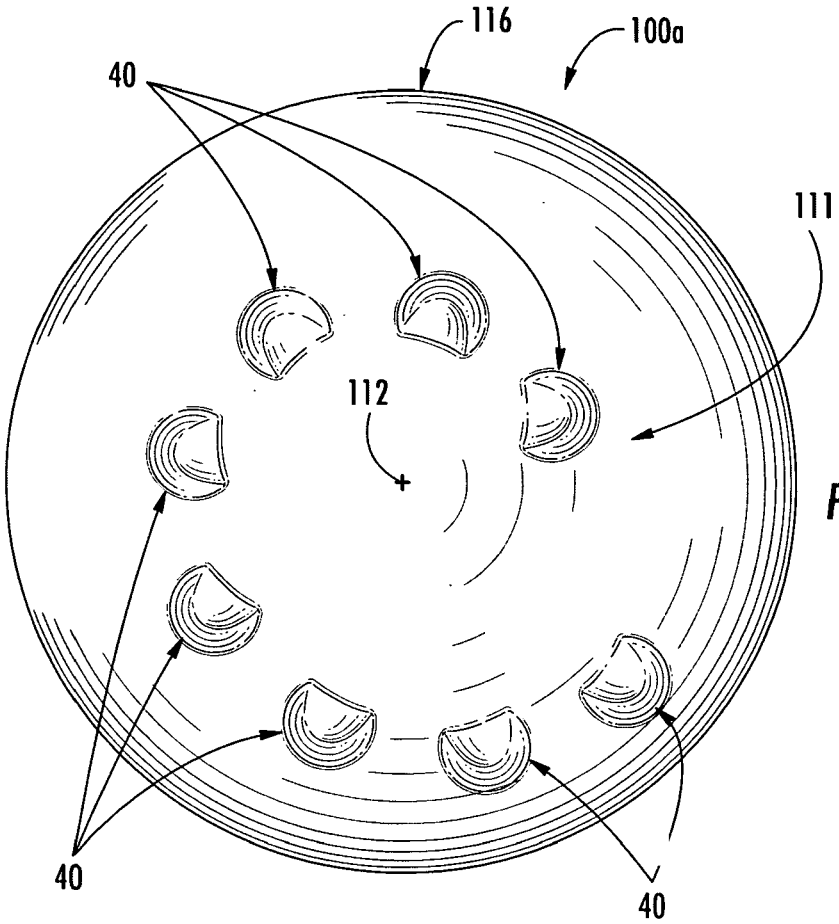
FIG. 15 is a top view of the flying disc of FIG. 9, but having contoured features arranged in a spiral pattern wherein the contoured features are provided at increasingly greater distances from the central axis of the disc as measure in the radial direction from the central axis.

FIG. 15 illustrates the contoured features 40 in a spiral pattern wherein the contoured features 40 are provided at increasingly greater distances from the central axis of the disc 100*a*, as measured radially from the central axis 112.

Figure 16:
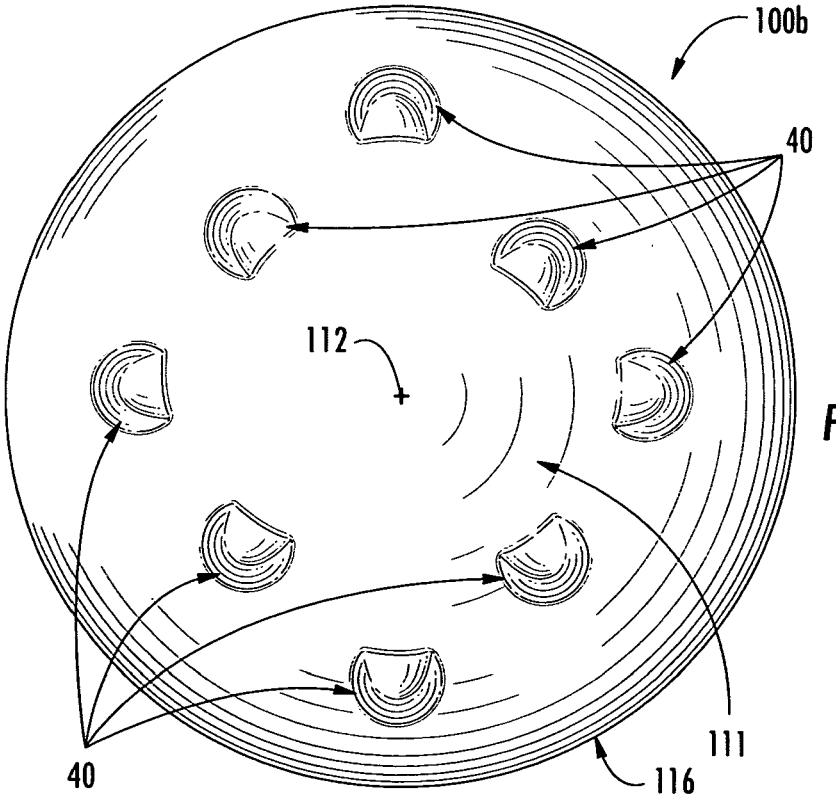
FIG. 16 is a top view of the flying disc of FIG. 9, but having contoured features arranged generally in a diamond pattern.
Figure 17:
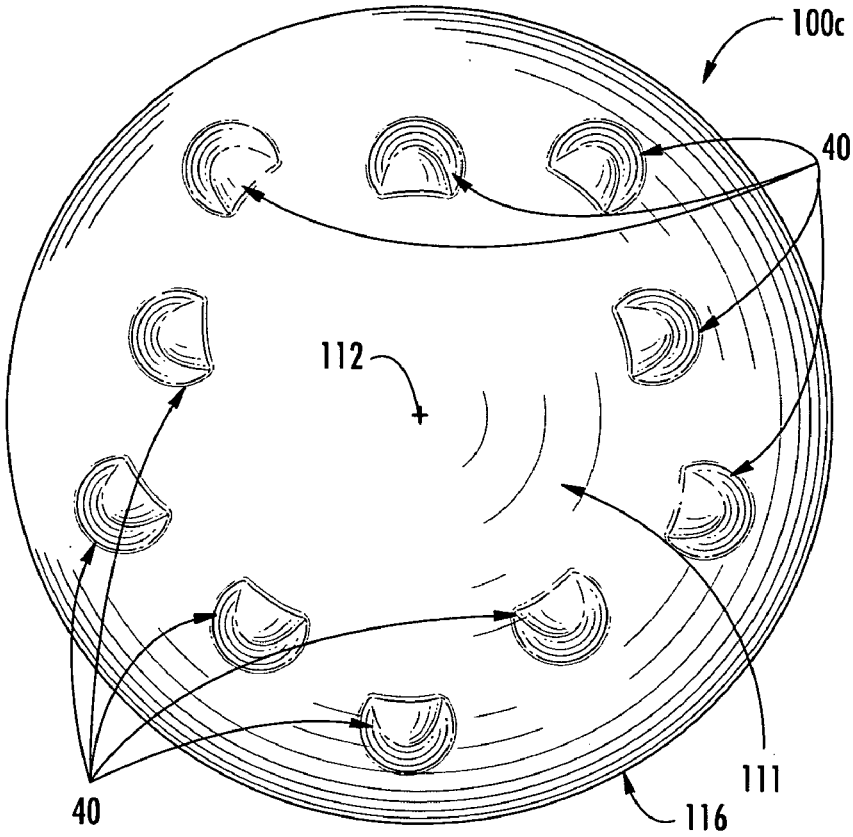
FIG. 17 is a top view of the flying disc of FIG. 9, but having contoured features arranged generally in a pentagonal pattern.
Figure 18:
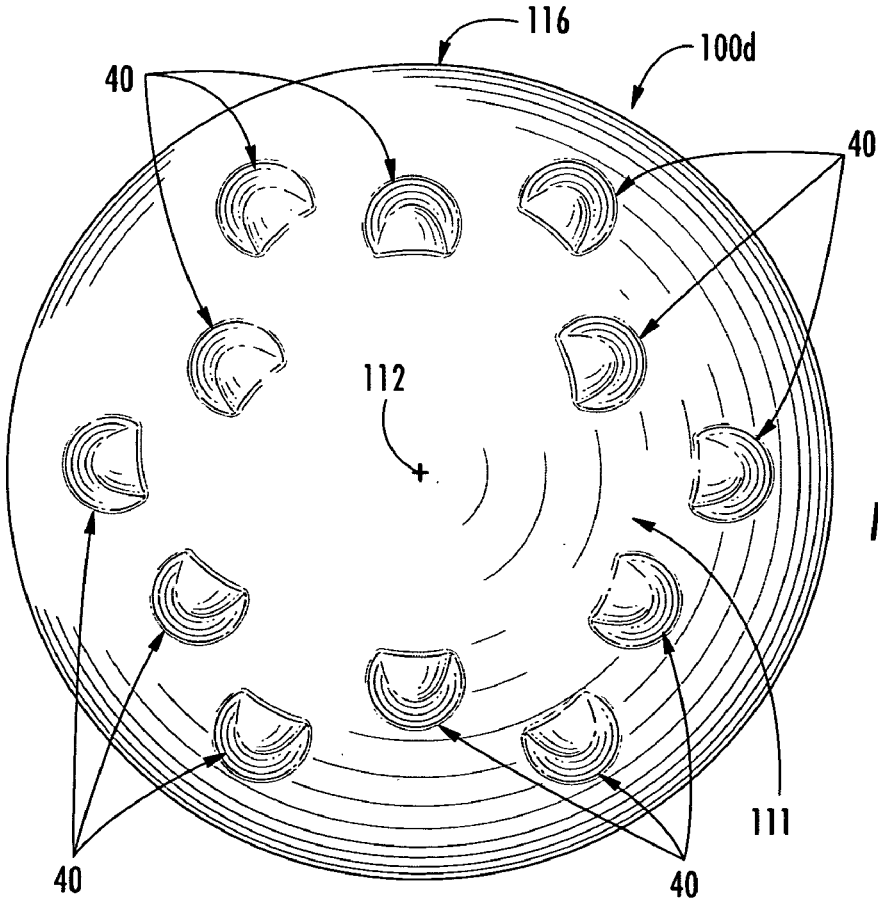
FIG. 18 is a top view of the flying disc of FIG. 9, but having contoured features arranged generally in a six-sided star pattern.

FIGS. 16–18, respectively illustrate a diamond pattern, generally a pentagonal pattern, and a six-sided star pattern, wherein in each embodiment the contoured features 40 are provided at two different distances from the central axis 112 of the disc 100*b*–*d*, as measured radially from the central axis 112. By having multiple contoured features 40 at the same radial distance, if one part of the disc 100*b*–*d* is damaged (ie rough, dented, or otherwise undesirable) an alternative contoured feature 40 that would accommodate the same grip is available elsewhere in the disc 100*b*–*d*.

Figure 19:
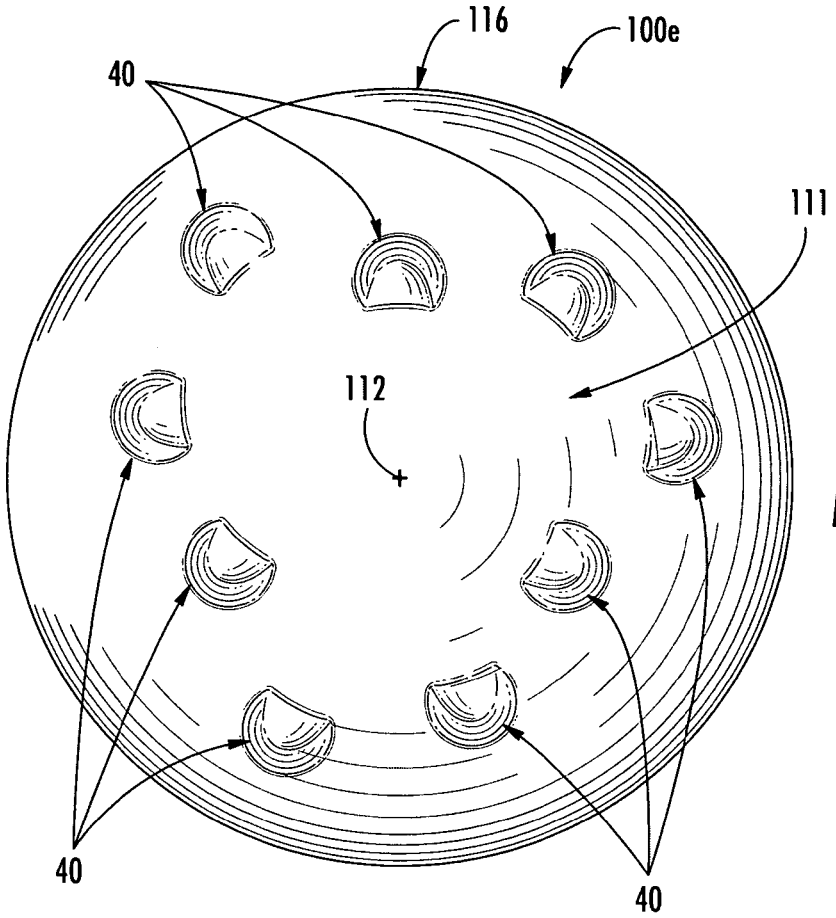
FIG. 19 is a top view of the flying disc of FIG. 9, but having contoured features arranged in a repeating arc pattern, wherein each arc includes an outer, middle and inner contoured feature.
Figure 20:
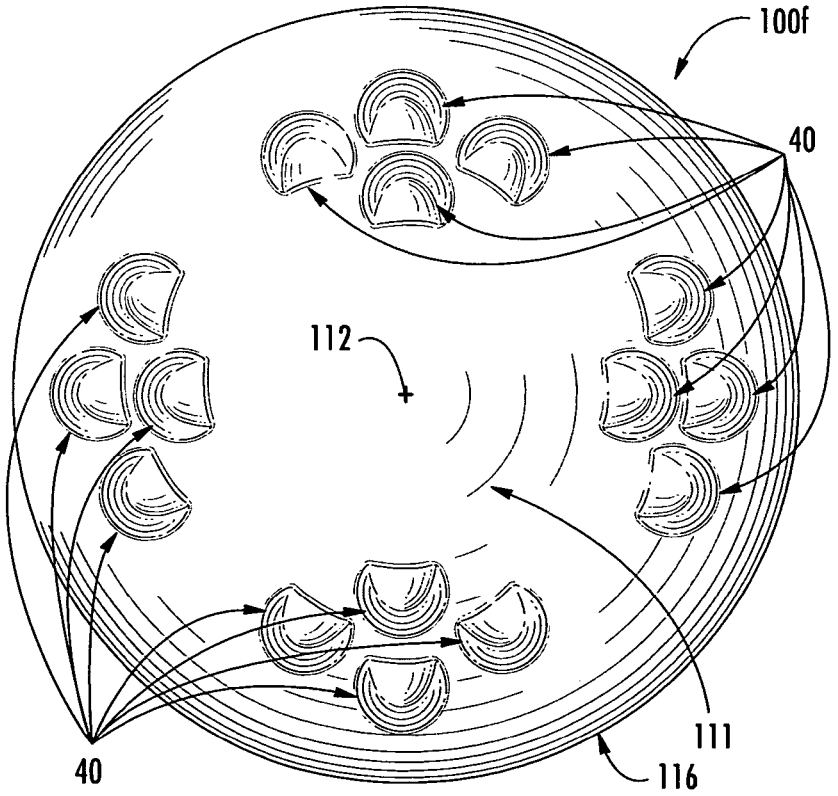
FIG. 20 is a top view of the flying disc of FIG. 9, but having contoured features arranged in a cluster pattern of four contoured features.

FIG. 19 illustrates a disc 100*e* having contoured features 40 in a repeating arc pattern, each arc having an outer, middle and inner contoured feature, thereby providing features 40 at three different gripping distances. FIG. 20 illustrates a disc 100*f* having a clusters of four contoured features 40 in order to provide for different grips.

Referring to FIG. 1, in use, the thrower may grip the disc 10 in a variety of fashions, including grasping the top and/or bottom of the contoured features 40. The various grips facilitate performing different types of throws and shots including trick shots.

Occasionally, it is desired to roll the disc 10 a distance on the ground. By having recessed contoured features 40, the center of mass of the flying disc 10 is positioned lowered (in a vertical sense); closer to the midpoint of the rim 16 (as viewed from a side view). It is thought that this more central center of mass allows for greater roll distance before the disc 10 tips over.

The contour features 40 also allow for the thrower to impart greater snapping force during disc launch. When thrown, particularly at high a speed (velocity and revolutions), the contoured features 40 cause a Coanda effect which assists in stabilizing the disc 10 during flight. At lower speeds, the Coanda effect is less pronounced (actually having no noticeable effect). That is, at higher speeds, the contoured features 40 maintain the disc 10 in a more predictable and accurate flight path, but does not impact flight at lower speeds, at which the disc 10 already has desirable fight characteristics.

The foregoing is a description of various embodiments of the invention that are provided here by way of example only. Although the flying disc of the present invention has been described with reference to preferred embodiments and examples thereof, other embodiments and examples may perform similar functions and/or achieve similar results. All such equivalent embodiments and examples are within the spirit and scope of the present invention and are intended to be covered by the appended claims.

What is claimed is:

1. A flying disc, comprising:

a flight deck section having a top surface and a bottom surface and having a plurality of contoured features, wherein each of said contoured features defines a cavity within the top surface said flight deck section;

a rim integral with said flight deck section; and wherein each of said contoured features protrudes beneath the bottom surface of said flight deck section and wherein at least two of said contoured features are equal-distantly spaced from the central axis of said disc as measured in the radial direction from the central axis.

2. The flying disc according to claim 1 wherein said contoured features are positioned at two or more distances as radially measured from the central axis of said disc.

3. The flying disc according to claim 2 wherein said contoured features are positioned in an eccentric, semi-circular pattern.

4. The flying disc according to claim 1 wherein the cavities extend beneath the bottom surface of said flight deck section.

5. The flying disc according to claim 1 wherein said contoured features include a downwardly angled generally U-shaped first section and an upwardly angled generally C-shaped second section.

6. The flying disc according to claim 1 wherein the cavities have a maximum depth in a range from 0.35 cm to 0.55 cm.

7. The flying disc according to claim 1 wherein the cavities have a span along their major axis in a range from 1.5 cm to 3.5 cm.

8. The flying disc according to claim 1 wherein the cavities have a maximum depth in a range from 0.35 cm to 0.45 cm and a span along their major axis in a range from 2.0 cm to 2.5 cm.

9. The flying disc according to claim 1 wherein said contoured features include at least one gripping rib.

10. A flying disc, comprising:

a flight deck section having a top surface and a bottom surface and having a plurality of contoured features, wherein each of said contoured features defines a cavity within the top surface of said flight deck section;

a rim integral with said flight deck section; and wherein each of said contoured features are positioned at a different distance from the central axis of said disc as measured in the radial direction from the central axis.

11. The flying disc according to claim 10 wherein the contoured features are positioned in a spiral pattern.

12. The flying disc according to claim 10 wherein the cavities extend beneath the bottom surface of said flight deck section.

13. The flying disc according to claim 10 wherein said contoured features include a downwardly angled generally U-shaped first section and an upwardly angled generally C-shaped second section.

14. The flying disc according to claim 10 wherein the cavities have a maximum depth in a range from 0.35 cm to 0.55 cm.

15. The flying disc according to claim 10 wherein the cavities have a span along their major axis in a range from 1.5 cm to 3.5 cm.

16. The flying disc according to claim 10 wherein the cavities have a maximum depth in a range from 0.35 cm to 0.45 cm and a span along their major axis in a range from 2.0 cm to 2.5 cm.

17. The flying disc according to claim 10 wherein each of said contoured features protrudes beneath the bottom surface of said flight deck section.

* * * * *